US005308413A

United States Patent [19]

Sobata et al.

[11] Patent Number: 5,308,413

[45] Date of Patent: May 3, 1994

[54] PROCESS FOR PHOSPHATING METAL SURFACE TO MAKE THEREON A ZINC PHOSPHATE COATING FILM

[75] Inventors: Tamotsu Sobata; Teturo Kishimoto; Minoru Ishida, all of Osaka, Japan

[73] Assignee: Nippon Paint Co., Ltd., Osaka, Japan

[21] Appl. No.: 686,463

[22] Filed: Apr. 17, 1991

[30] Foreign Application Priority Data

Apr. 24, 1990 [JP] Japan ..... 2-109426

[51] Int. Cl.[5] ..... C23C 22/73

[52] U.S. Cl. ..... 148/255; 148/262

[58] Field of Search ..... 148/260, 262, 255

[56] References Cited

U.S. PATENT DOCUMENTS 3,619,300 11/1971 Heller et al. .
3,839,988 10/1974 Düerr .

FOREIGN PATENT DOCUMENTS 0106459 4/1984 European Pat. Off. .
0381190 8/1990 European Pat. Off. .
2100616 3/1972 France .
42-17632 9/1967 Japan .
57-70281 4/1982 Japan .
57-152472 9/1982 Japan .
61-104089 5/1986 Japan .
61-36588 8/1986 Japan .
2-36432 2/1990 Japan .
1297715 11/1972 United Kingdom .

OTHER PUBLICATIONS

EP-381-190-A Aug. 8, 1990.

*Primary Examiner*—Sam Silverberg
*Attorney, Agent, or Firm*—Lowe, Price, LeBlanc & Becker

[57] ABSTRACT

A metal surface is processed with dipping by a first zinc phosphating solution in which a fluoride complex and a simple fluoride are contained and a concentration of this simple fluoride is 200 to 300 mg/l on a basis converted into the HF concentration and that of the fluoride complex is in a mole ratio with the simple fluoride converted into the HF as shown as, [fluoride complex]/[simple fluoride]≧0.01, and then the surface is processed with spraying by a second zinc phosphating solution in which a simple fluoride concentration is 500 mg/l or less and higher than that in said first zinc phosphating solution.

Thus, on a metal surface is formed a zinc phosphate coating film which is suitable for electrodeposition coating, particular for cationic electrodeposition coating, and superior in coating film adhesion, corrosion-resistance, particularly resistance for warm brine, and prevention of scab-corrosion.

2 Claims, 2 Drawing Sheets

PROCESS FOR PHOSPHATING METAL SURFACE TO MAKE THEREON A ZINC PHOSPHATE COATING FILM

BACKGROUND OF THE INVENTION

The present invention relates to a process for phosphating a metal surface to make thereon a zinc phosphate film for coating use. More particularly, it relates to a process for phosphating the surface of a metallic matter to make thereon a zinc phosphate film suitable for electrodeposition coating, particularly for cationic electrodeposition coating, excellent in adhesion and corrosion-resistance, particularly in resistance for warm brine and scab corrosion (hereinafter, the term "resistance for scab corrosion" is referred to as "anti-scab property"), wherein the metal surface is intend to mean an iron-based surface, a zinc-based surface, an aluminum-based surface, or a metal surface having two or more kinds of these surfaces together and simultaneously, in particular, a metal surface having an aluminum-based surface, which comprises a part processed with an abrasive, and an iron-based and/or zinc-based surfaces together and simultaneously.

There have been used metallic materials in various kinds of articles such as car bodies and other automobile parts, building materials, and furniture, etc. The metallic materials are processed as pre-treatment to make a zinc phosphate coating film in order to avoid corrosion due to oxygen and sulfur oxides in the atmosphere and to rain and sea water. The zinc phosphate coating film thus-formed is desired to be excellent in adhesion with a metal surface, that is a substrate, and with a film being thereon formed and also, desired to have sufficient rust-resistance under the corrosive environment. Especially, because the car bodies are repeatedly exposed to brine and a change of dry and wet weather conditions through scratches of the outer plate parts, anti-scab property and high order of resistance for warm brine, etc. are strongly desired. In the present invention, the term "a phosphating process" used herein is employed to mean "a process for phosphating a metal surface to make thereon a zinc phosphate coating film".

Recently, there are increasing cases where metallic materials having two or more kinds of metal surfaces are phosphated with zinc phosphate to make a phosphate film. For example, in order to further elevate the corrosion-resistance of car bodies, there has been employed a material which is plated with zinc or alloyed zinc at only one side of steel material. If a hitherto-known zinc phosphating process is carried out for a metal surface, as mentioned above, which has an iron-based and a zinc-based surfaces together and simultaneously, there takes place a problem that the corrosion-resistance and secondary adhesion of a zinc-based surface are inferior compared to those of an iron-based surface. Because of this, for example, there has been proposed, in Japanese Official Patent Provisional Publication, showa 57-152472 etc., a process for making a zinc phosphate film suitable for electrodeposition coating on a metal surface having an iron-based and a zinc-based surfaces together and simultaneously. In a phosphating bath of this process, wherein concentrations of a zinc and phosphate ions as well as that of an accelerator for forming a coating film with conversion are controlled, a manganese and/or nickel ions are contained in concentrations of 0.6 to 3 g/l and/or 0.1 to 4 g/l, respectively. Also, there is proposed, in Japanese Official Patent Gazette, showa 61-36588, an art in which 0.05 g/l or more of a fluoride ion are added together with a manganese ion in order to lower a processing temperature.

Moreover, a material made of combining an aluminum material with an iron material or a zinc material has been practically used in various kinds of articles such as automobiles and building materials. If a material of this kind is processed with an acidic solution for making a zinc phosphate film which has so-far been employed for an iron or zinc material, an aluminum ion dissolving into the phosphating solution accumulates and, when the accumulated amount becomes higher more than a certain extent, a problem of converting inferiority on an iron-based surface takes place. That is, if the aluminum ion becomes 5 ppm or more in a phosphating solution which does not contain a fluoride ion, 100 ppm or more in a phosphating solution which contains $HBF_4$, or 300 ppm or more in a phosphating solution which contains $H_2SiF_6$, converting inferiority occurrence has been found on an iron-based surface.

Thus, to prevent an increase of the aluminum ion in a phosphating solution, there has been proposed, in Japanese Official Patent Provisional Publication, showa 57-70281, a process which comprises precipitating the aluminum ion as $K_2NaAlF_6$ or $Na_3AlF_6$ by adding potassium acid fluoride and sodium acid fluoride into a phosphating solution. Also, there has been proposed, in Japanese Official Patent Provisional Publication, showa 61-104089, a process which comprises controlling a proportion in area of an aluminum-based surface to an iron-based surface in 3/7 or less and maintaining concentration of the aluminum ion in 70 ppm or less.

The zinc phosphating process disclosed in the Japanese Official Patent Provisional Publication, showa 61-104089, has a disadvantage by which a matter for making a coating film with a phosphating process (hereinafter, simply referred to as "phosphating object") is very limited and, in addition, it is difficult to maintain the aluminum ion concentration at 70 ppm or less by means of only controlling the forementioned area proportion. On the other hand, the phosphating process disclosed in the Japanese Official Patent Provisional Publication, showa 57-70281, is superior in points of that the processing objects is not limited and an idea of removing the aluminum ion in a phosphating solution with precipitating has been adopted. However, a precipitate formed herein shows a tendency of floating with suspending and makes non-uniform a zinc phosphate coating film by attaching to it. Because of this, in a case where electrodeposition coating is carried out on a zinc phosphate coating film, inferior electrodeposition coating takes place and, as a result, it becomes a factor for lack of coating film uniformity and inferior secondary adhesion in the coating film. Accordingly, there is a necessity to remove the floating and suspending precipitate, but this removing works is very complicate.

The present inventors undertook researches to solve the problems in previous arts as described above and, as a result, invented a process, in which a simple fluoride is added into a phosphating solution taken out from a phosphating bath in order to remove the aluminum ion with precipitating and then, the solution is again returned to the phosphating bath and, as a result, the aluminum ion concentration in the bath is maintained at a definite value or less, and which was applied for a patent, Japanese Patent Application, heisei 2-36432.

According to this process, because the aluminum ion concentration is always maintained within a proper range, inferior conversion on a metal surface does not take place. Besides, since any precipitate is not formed in a phosphating bath, any bad influence by the precipitate upon a coating film does not take place.

However, even by a phosphating process in the forementioned previous arts, in a case where a part or a whole of the aluminum-based metal surface has been processed with an abrasive, it was found that in this part processed with an abrasive any zinc phosphate coating film is not formed or a non-uniform coating film is only formed, so that there is a problem by that corrosion-resistance in the part becomes very inferior. This is, in an aluminum-based metal, because an inactive film is formed on a surface by being processed with an abrasive and, by this inactive film, formation of a coating film is disturbed.

Even in the previous arts, if the active fluorine concentration in a phosphating solution is enhanced, the converting is improved by removing with dissolving the inactive film in the part processed with an abrasive, but when the active fluorine concentration is high, an amount of the dissolving aluminum ion increases in a part other than the part processed with an abrasive, that is an abrasive-nonprocessed part, and thus, an aluminum ion precipitation in the phosphating bath occurs in a great extent, a concentration of sludge floating and suspending in a phosphating solution in a phosphating bath, that is the precipitate concentration, becomes high and, as a result, there takes place inferior electrodeposition coating by attaching of the precipitate to a processing object.

SUMMARY OF THE INVENTION

Accordingly, the present invention has an object to provide a process for phosphating a metal surface to make thereon under a stable condition a zinc phosphate coating film superior in adhesion and of high corrosion-resistance, wherein the process can be applied, with an identical phosphating solution to make a zinc phosphate coating film, for an iron-based, a zinc-based, and an aluminum-based surfaces as well as a metal surface having two or more kinds of these surfaces simultaneously and, particularly, it can be applied even when an aluminum-based surface having an abrasive-processed part is processed simultaneously and in succession.

The process for phosphating a metal surface to make thereon a zinc phosphate coating film as claimed in claim 1 among the present inventions for solving the forementioned object, wherein a metal surface is brought in contact with a phosphating solution to make a zinc phosphate coating film on the metal surface, is characterized by that the metal surface is processed with dipping with a first zinc phosphating solution containing a fluoride complex and simple fluoride, wherein concentration of the simple fluoride is 200 to 300 mg/l on a basis converted into the HF concentration and concentration of the fluoride complex is shown in a mole ratio with that of the simple fluoride on a basis converted into the HF concentration according to the following equation:

$$[\text{fluoride complex}]/[\text{simple fluoride}] \geqq 0.01$$

and characterized by that the metal surface is then processed with spraying with a second zinc phosphating solution wherein concentration of the simple fluoride is 500 mg/l or less on a basis converted into the HF concentration and the simple fluoride concentration is higher than that of the first zinc phosphating solution.

The metal surface which is an object in the phosphating process of the present invention is an iron-based surface alone, a zinc-based surface alone, an aluminum-based surface alone, or a metal surface having jointly two or more kinds of these surfaces and, in particular, most effectively processed is a case where a metal surface having jointly an aluminum-based surface comprising an abrasive-finishing part is an object. Also, the shape of metal surfaces may be a flat plate or may have a part of bag structure and it is not especially limited. By this invention, an inside surface of the bag structure part is processed similarly to its outside surface and the flat plate.

The first zinc phosphating solution used in the dipping process is explained.

First, a simple fluoride is contained in a concentration of 200 to 300 mg/l on a basis converted into the HF concentration. If the simple fluoride concentration is less than 200 mg/l, the active fluorine concentration becomes too low, a uniform zinc phosphate coating film is not made on an aluminum-based metal surface. If it is too high, precipitation of an aluminum ion becomes too large, bad effects on a coating film takes place by a precipitate forming in a dipping phosphating bath. As the simple fluoride (this word means a fluoride derivative of simple structure in contrast with the fluoride complex) are used, for example, HF, NaF, KF, $NH_4F$, $NaHF_2$, $KHF_2$, and $NH_4NF_2$, etc.

A fluoride complex is contained in a mole ratio to the simple fluoride on a basis converted into the HF concentration as shown as, $$[\text{fluoride complex}]/[\text{simple fluoride}] \geqq 0.01$$

If the mole ratio of the fluoride complex to the simple fluoride is less than 0.01, the $Na_3AlF_6$ component is contained in a zinc phosphate coating film on an aluminum-based surface and, when cationic electrodeposition coating is carried out on the surface, the resistance for warm brine of the coating film lowers. As the fluoride complex are used, for example, $H_2SiF_6$, $HBF_4$, and these metal salts, etc. (for example, a nickel salt and zinc salt, etc.). However, in the present invention an aluminum-containing fluoride complex is not included as the fluoride complex.

It is preferred to adjust an active fluorine concentration of the phosphating solution in a proper range. In a method for controlling the active fluorine concentration, a value indicated by a silicon electrode meter can be used as a standard. The silicon electrode meter has a high sensitivity in a pH range (an acidic region) of the phosphating solution used in the present invention and also, has a characteristic property with which a value indicated becomes large in proportion to the active fluorine concentration, so that it is a preferable means for determining the active fluorine concentration. It is preferred that a value indicated by this silicone electrode meter is in a range of 15 to 40 $\mu$A. If this indicated value is less than 15 $\mu$A, the active fluorine concentration is low and the conversion of a coating film is inferior. If it exceeds 40 $\mu$A, a precipitating tendency in a dipping phosphating bath increases, a sludge concentration in the phosphating solution becomes high, a precipitate attaches to an object to be processed, and the forementioned electrodeposition coating inferiority etc. takes place.

As the silicon electrode meter is used, for example, a silicon electrode meter disclosed in Japanese Official Patent Gazette, showa 42-17632, but the meter is not limited with this example and various kinds of silicon electrode meters which indicate the value similarly can be used and, even it is not a silicon electrode meter, as far as it can determine the active fluorine concentration, various kinds of measuring devices can be used. If the measuring device is different, a value indicated for the same active fluorine concentration is different and, therefore, when a measuring device other than the silicon electrode meter is used, a numerical value in an indicated value range should be before use converted into a value indicated with each measuring device.

As a practical example of the silicon electrode meter for determining the active fluorine concentration is cited the Surfproguard 101N (a trade name, made by Nippon Paint Co., Ltd.) and the numerical value of the forementioned indicated value is given by using a value determined with this silicon electrode meter as a standard. This silicone electrode meter is arranged so as to read an electric current value by bringing a p-type silicon electrode and an inactive electrode made of platinum in contact with a solution to be measured under a condition where the solution is not in light and by connecting a direct current between both of these electrodes. The solution to be measured is arranged so as to be at a stationary state or to be in a constant current. Then, under these conditions a direct current is impressed between both the electrodes, so that the active fluorine concentration is known by reading an electric current when it becomes a steady state.

Besides, if the first zinc phosphating solution is adjusted so that the simple fluoride concentration and mole ratio of "a fluoride complex" to "a simple fluoride" are in the forementioned range, kind and concentration of the other components are set similarly to those of an usual phosphating solution. Among these other components, it is required that the zinc and phosphate ions and an accelerator for converting a coating film are contained, but other components are properly combined in case of necessity.

Next, regarding the second zinc phosphating solution used for the spraying process, fundamental composition and combined components are similar to those of the first phosphating solution, so that different points are only explained.

First, a phosphating solution used is such that a concentration of the simple fluoride is 500 mg/l or less on a basis converted into the HF concentration and the simple fluoride concentration is higher than that of the first phosphating solution. By being spray-processed with the second phosphating solution in which the simple fluoride concentration is higher than that of the first phosphating solution, an excellent coating film is formed even at a part processed with an abrasive on an aluminum-based surface, but if the simple fluoride concentration exceeds 500 mg/l the $Na_3AlF_6$ component is contained in a coating film formed on a surface of the part processed with an abrasive, so that the corrosion-resistance lowers as well as a coating film formed at a part other than the part processed with an abrasive, that is a nonprocessed part with an abrasive, dissolves again in the dipping process and, therefore, the corrosion-resistance lowers. Compared with the first phosphating solution, how much the simple fluoride concentration in the second phosphating solution should be enhanced differs with arranging of the simple fluoride concentration in the first phosphating solution and with conditions of the part processed with an abrasive on a surface of the aluminum-based metal.

The active fluoride concentration in the second phosphating solution prefers to be 15 to 130 μA at a value indicated by the forementioned silicon electrode meter and to be higher than an indicated value of the first phosphating solution. More preferable is that the value indicated is set at 40 to 110 μA. If the value is less than 15 μA, the active fluorine concentration is low, a non-uniform coating film is formed at the part processed with an abrasive on a surface of the aluminum-based metal, and the corrosion-resistance of this part is not sufficiently elevated. If the value exceeds 130 μA, the active fluorine concentration becomes too high and there takes place a problem similar to the case where the simple fluoride concentration is too high.

For the forementioned first and second phosphating solutions, the undermentioned components other than the simple fluoride and fluoride complex can be contained.

In the main components in the zinc phosphating solution, the components other than the simple fluoride, fluoride complex, and active fluorine are, for example, a zinc ion, a phosphate ion, and an accelerator for forming a coating film with conversion (a). As the accelerator for forming a coating film with conversion (a) is used at least one kind selected from a nitrite ion, a metanitrobenzenesulfonate ion, and hydrogen peroxide. Their preferable concentrations (more preferable concentrations are shown in parentheses) are 0.1 to 2.0 (0.3 to 1.5) g/l for the zinc ion, 5 to 40 (10 to 30) g/l for the phosphate ion, 0.01 to 0.5 (0.01 to 0.4) g/l for the nitrite ion, 0.05 to 5 (0.1 to 4) g/l for the meta-nitrobenzenesulfonate ion, and 0.5 to 10 (1 to 8) g/l (on a basis converted into 100% $H_2O_2$) for hydrogen peroxide. The free acidity (FA) prefers to be adjusted in a range of 0.5 to 2.0.

If the zinc ion concentration is less than 0.1 g/l, an uniform zinc phosphate coating film is not formed on a metal surface, lack of hiding is much, and sometimes in part, a coating film of a blue color type is formed. Also, if the zinc ion concentration exceeds 2.0 g/l, an uniform zinc phosphate coating film is formed, but the coating film is such as easily dissolved in an alkali and, especially under an alkali atmosphere being exposed during a cationic electrodeposition process, the coating film sometimes easily dissolves. As a result, the resistance for warm brine generally lowers and, especially in a case of an iron-based surface, the anti-scab property deteriorates, and thus, desired properties are not obtained. Therefore, it is not suitable as a substrate for electrodeposition coating, especially for cationic electrodeposition coating.

If the phosphate ion concentration is less than 5 g/l, a non-uniform coating film is apt to be formed, and if it exceeds 40 g/l, elevation of effects can not be expected and an mount for use of a drug becomes large with causing an economical disadvantage.

When the concentration of an accelerator for forming a coating film with conversion (a) is lower than the forementioned range, sufficient coating film-converting is not possible on an iron-based surface and yellow rust is easily formed and, if the concentration exceeds the range, a non-uniform coating film of a blue color type is easily formed on an iron-based surface.

The FA is defined by a ml amount of a 0.1 N-NaOH solution consumed to neutralize 10 ml of the phosphating solution using bromophenolblue as an indicator. If the FA is less than 0.5, an uniform zinc phosphate coating film is not formed on an aluminum-based surface and, if it exceeds 2.0, a zinc phosphate coating film containing the $Na_3AlF_6$ component is formed on an aluminum-based surface and the corrosion-resistance sometimes lowers.

Also, the phosphating solutions are desired to contain a manganese and a nickel ion in a specially defined concentration range, besides said main components. The manganese ion prefers to be in a range of 0.1 to 3 g/l and more prefers to be in a range of 0.6 to 3 g/l. If it is less than 0.1 g/l, the adhesion with a zinc-based surface and an effect upon elevating the resistance for warm brine become insufficient and also, if it exceeds 3 g/l, an effect upon elevating the corrosion-resistance becomes insufficient. The nickel ion prefers to be in a range of 0.1 to 4 g/l and more prefers to be in a range of 0.1 to 2 g/l. If it is less than 0.1 g/l, an effect upon elevating the corrosion-resistance becomes insufficient and also, if it exceeds 4 g/l, there is a trend that the effect upon elevating the corrosion-resistance decreases.

Furthermore, in case of necessity, the phosphating solution may contain an accelerator for forming a coating film with conversion (b). As the accelerator for forming a coating film with conversion (b) are cited, for example, a nitrate ion and a chlorate ion, etc. The nitrate ion prefers to be in a range of 0.1 to 15 g/l and more prefers to be in a range of 2.0 to 10 g/l. The chlorate ion prefers to be in a range of 0.05 to 2.0 g/l and more prefers to be in a range of 0.2 to 1.5 g/l. These components may be contained by alone or in combination of two or more kinds. The accelerator for forming a coating film with conversion (b) may be used in combination with the accelerator for forming a coating film with conversion (a) or without combination with this.

As a supplying source of each of components to be contained in said phosphating solutions are used, for example, the following ions.

Zinc ion

Zinc oxide, zinc carbonate, and zinc nitrate, etc.

Phosphate ion

Phosphoric acid, zinc phosphate, and manganese phosphate, etc.

Accelerator for forming coating film with conversion (a)

Nitrous acid, sodium nitrite, ammonium nitrite, sodium meta-nitrobenezensulfonate, and hydrogen peroxide, etc.

Managanese ion

Manganese carbonate, manganese nitrate, manganese chloride, and manganese phosphate, etc.

Nickel ion

Nickel carbonate, nickel nitrate, nickel chloride, nickel phosphate, and nickel hydroxide, etc.

Nitrate ion

Nitric acid, sodium nitrate, ammonium nitrate, zinc nitrate, manganese nitrate, and nickel nitrate, etc.

Chlorate ion

Sodium chlorate and ammonium chlorate, etc.

Next, the phosphating processes in the present invention using the first and second phosphating solutions are explained.

At first, the dipping process at the first step is carried out by dipping a phosphating object for a definite period of time in a dipping phosphating bath, which has stored the first phosphating solution. With this dipping, a coating film of superior adhesion and high corrosion-resistance is formed on a part other than a part of an aluminum-based metal surface processed with an abrasive in the phosphating object, that is an iron-based and a zinc-based surfaces as well as a part of the aluminum-based metal surface not processed with an abrasive and the like. Practical phosphating conditions and devices for the dripping are similar to those in usual phosphating processes.

The spraying at the second step is carried out by spraying the second phosphating solution for the surface of a phosphating object with an usual spraying mechanism. At this time, it is preferred that the phosphating solution is sprayed in at least good contact with a part of an aluminum-base metal surface processed with an abrasive. By this spraying, the part of an aluminum-based metal surface processed with an abrasive is also formed with a coating film of superior adhesion and high corrosion-resistance. Since a part other than that of the aluminum-based metal surface processed with an abrasive has already been formed with a coating film by the dipping in the previous step, in this spraying process sufficient contact of the phosphating solution is not necessary. Practical phosphating conditions and devices in the spraying are similar to those in usual phosphating processes.

Next, in the above-described phosphating processes, if successive processing of a metal surface containing an aluminum-based surface is carried out in the dipping of the first step, there takes place a problem of that the concentration of an aluminum ion in the first phosphating solution stored in the dipping phosphating bath becomes high. If this aluminum ion concentration exceeds 150 ppm, sludge containing aluminum is formed with precipitating of an aluminum ion and the converting becomes unstable. Therefore, in the dipping process, in order to maintain good converting in succession for a long period of time, it is preferred to selectively remove an aluminum ion from the first phosphating solution in the dipping phosphating bath.

For removing an aluminum ion, the precipitating and removing process of an aluminum ion disclosed in the forementioned Japanese Patent Application, heisei 2-36432, can be adopted. Practically, a phosphating solution, which has been used in the dipping process and has shown a high aluminum ion concentration, is successively or intermittently sent to a precipitating bath arranged in an outside of the dipping phosphating bath, in this precipitating bath a simple fluoride is added to precipitate the aluminum ions in the phosphating solution, this precipitate is filtered, and separated and removed from the phosphating solution, and then, the phosphating solution from which an aluminum ion was removed is again returned to the dipping phosphating bath. According to this process, because an aluminum ion concentration in equilibrium in the dipping phosphating bath can always be maintained at a definite value or less, it is possible to stably display good converting for a long period of time. For practical conditions and devices for a precipitating process and for a process removing the precipitate, those in usual chemical processes can be applied.

Besides, in the precipitating bath it is preferred to add the simple fluoride in a range as shown as,

[fluoride complex]/[simple fluoride]≦0.5 (mole ratio)

If this value exceeds 0.5, filtration of the precipitate becomes difficult because the aluminum ions does not form a water-insoluble fluoride complex having a good precipitating character. Also, it is desired to add the simple fluoride so that the active fluoride concentration in the precipitating bath is 40 μA or more or, more preferably, 130 μA or more in the value indicated by a silicon electrode meter. If this active fluorine concentration (a value indicated by a silicon electrode meter) is less than 40 μA, filtration of the precipitate becomes difficult because an aluminum ion does not form a water-insoluble fluoride complex having a good precipitating character.

An amount of the simple fluoride to be added into the precipitating bath gives an effect upon the simple fluoride and an active fluoride concentrations in the phosphating solution which is returned to the dipping phosphating bath. Therefore, the amount of the simple fluoride to be added into the precipitating bath is required to adjust so that the first phosphating solution in the dipping phosphating bath to which the refluxing phosphating solution has been returned may not deviate from the above-mentioned simple fluoride concentration range and active fluorine concentration range (a value indicated by a silicon electrode meter). Besides, a phosphating solution taken out from the dipping phosphating solution is low in the simple fluoride and active fluoride concentrations because of these consumption in the dipping process, but the decreased concentration of the simple fluoride or active fluorine is supplemented by adding the simple fluoride in the precipitating process.

Next, in the present invention the process as claimed in claim 2 is characterized by that a phosphating solution used in the dipping process is led to an outside of a dipping phosphating bath, a simple fluoride is added to the phosphating solution, a thus-formed aluminum ion precipitate is removed, then the phosphating solution is used as the second phosphating solution in the spraying process, and the phosphating solution used in the spraying process is again returned to the dipping phosphating bath and used as the first phosphating solution.

That is, in the present invention, the first phosphating solution used in the dipping process is processed to remove the aluminum ion precipitate, and then this phosphating solution processed with the aluminum ion-removing is used as a second phosphating solution in the spraying process.

Although the removing process of an aluminum ion precipitate is carried out according to the forementioned processing conditions, a phosphating solution, from which an aluminum ion has been removed by properly adjusting such a processing condition as an adding amount of the simple fluoride to the removing process of a precipitate, is satisfactory for all conditions required as the forementioned second phosphating solution. That is, in the above-described process wherein a phosphating solution which has finished the removing process of an aluminum ion precipitate is immediately returned to the dipping phosphating bath, the removing process of an aluminum ion precipitate is conditioned so that the phosphating solution in the dipping phosphating bath to which a refluxing solution has been returned has satisfactory conditions as the first phosphating solution. On the other hand, in this process, the removing process of an aluminum ion precipitate is conditioned so that the phosphating solution, from which an aluminum ion has been removed, may have necessary conditions as the second phosphating solution. However, in the usual precipitate-removing process, in order to surely precipitate an aluminum ion, an amount of the added simple fluoride is set in amount somewhat larger than that required for precipitating an aluminum ion in the phosphating solution and, therefore, a phosphating solution which has finished a precipitate-removing process is usually higher in the simple fluoride concentration than the first phosphating solution and, even if a special processing condition is not set, a phosphating solution which has finished the precipitate-removing process is satisfactory for the conditions required as the second phosphating solution.

If a phosphating solution like this is used as a second phosphating solution in the spraying process, an excellent spraying process as described above becomes possible. In particular, since the sludge (a precipitate) is not contained at all in the phosphating solution or is contained in a very low concentration, even if the sludge attaches to a surface of an phosphating object on which the dipping process has been carried out, it is possible to remove with washing the sludge nicely in the spraying process.

Since the phosphating solution used in the spraying process are now satisfactory for all conditions necessary for the first phosphating solution, when returned to the dipping phosphating bath, it can be used as the first phosphating solution. When the second phosphating solution is used in the spraying process, since the simple fluoride or active fluorine concentration lowers with consumption accompanied with the processing, the forementioned phosphating solution turns out to be satisfactory for the conditions required for the first phosphating solution in which the simple fluoride concentration is low.

As explained above, in this process an identical phosphating solution is circulatingly in order supplied for a dipping process in a dipping phosphating bath, a removing process of an aluminum ion precipitate in a precipitating bath etc., a spraying process in a spraying mechanism etc., and again a dipping process.

Next, a practically useful and concrete example of the phosphating process in the present invention is shown as the undermentioned. A metal surface is at first processed for degreasing with spraying and/or dipping at a temperature of 20° to 60° C. for 2 minutes using an alkaline degreasing agent and then, rinsed with tap water. After these, using the first zinc phosphating solution, the metal surface is processed with dipping at a temperature of 20° to 70° C. for 15 seconds or more and then, using the second zinc phosphating solution, the metal surface is processed with spraying by a spraying mechanism at a temperature of 20° to 70° C. for 15 seconds or more. After these, rinsing with tap water and rinsing with deionized water are carried out. In a case where the degreasing is carried out with the dipping, it is preferred to carry out the spraying and/or dipping processing of a metal surface at room temperature for 10 to 30 seconds using a surface-conditioner before the zinc phosphating process.

In performing the phosphating process of the present invention, temperature of the phosphating solution prefers a range of 20° to 70° C. and more prefers a range of 35° to 60° C. If it is lower than the range, the coating film-converting is bad and it is necessary to carry out the processing for a long period of time. Also, if higher than the range, balance of the phosphating solution is easily broken with decomposition of an accelerator for forming a coating film with conversion and with a precipitate formation in the phosphating solution, so that it is difficult to obtain a good coating film.

The dipping period of time by the first phosphating solution prefers to be 15 seconds or more and more prefers to be a range of 30 to 120 seconds. If it is less than 15 seconds, a coating film having desired crystals sometimes does not sufficiently form. The spraying period of time by the second phosphating solution prefers to be 15 seconds or more and more prefers to be a range of 30 to 60 seconds. If it is less than 15 seconds, a coating film is not sufficiently formed on a surface of an aluminum-based metal at a part processed with an abrasive. Besides, in order to wash off the sludge attached during the dipping process by a spraying process, a spraying period prefers a long time as much as possible.

The zinc phosphating solution used in the present invention is simply obtained by usually arranging beforehand a concentrated source solution which contains each component in an amount larger than the definite content and by diluting it with water or by others so that each component is adjusted so as to be in a definite content. The first phosphating and second phosphating solutions may be prepared by using source solutions separately arranged and, in a case as described above where an identical solution is circulated in both the dipping and spraying processes, an one-kind source solution is only arranged. As the one-kind of source solution in this case usually is preferred such as corresponding with the first phosphating solution.

There are as the concentrated source solution an one-solution type and a two-solution type and, practically, the following embodiments are cited.

(1) A concentrated source solution of the one-solution type which is blended so as to have a zinc ion-supplying source and a phosphate ion-supplying source in a ratio by weight of their ionic forms as shown as, zinc ion: phosphate ion = 1:2.5 to 400

(2) A concentrated source solution of the one-solution type as described in the forementioned (1), containing the forementioned accelerator for forming a coating film with conversion (b), of which coexistence in the source condition does not cause any trouble.

In a concentrated source solution of the one-solution type may be contained a proper compound among the forementioned nickel ion-supplying source compound, manganese ion-supplying source compound, simple fluoride-supplying source compound, and fluoride complex-supplying source compound, etc.

(3) A concentrated source solution of the two-solution type which is consisting of an A solution containing at least a zinc ion-supplying source and a phosphate ion-supplying source and a B solution containing at least the accelerator for forming a coating film with conversion (a) and is used so that the zinc ion-supplying source and the phosphate ion-supplying source are in a ratio by weight of the ionic forms as shown as, zinc ion:phosphate ion = 1:2.5 to 400

As compounds contained in the B solution are cited the above-described accelerator for forming a coating film with conversion (a) and such as having a trouble in coexistence with the zinc ion-supplying source and phosphate ion-supplying source under the conditions of source solutions.

Also, a compound for supplying a simple fluoride which is used for precipitating and removing an aluminum ion is preferably supplied for said precipitating bath by arranging a concentrated source solution (C) containing a compound of this kind.

The concentrated source solutions usually contain each component so as to be used by diluting 10 to 100 times (in a weight ratio) in a case of the one-solution type, 10 to 100 times (in a weight ratio) in a case of the A solution, 100 to 1000 times (in a weight ratio) in a case of the B solution, and 10 to 100 times (in a weight ratio) in a case of the C solution.

In a case of the two-solution type where a zinc phosphating solution is consisting of the forementioned A and B solutions, if compounds are not suitable in coexistence under a source solution condition, they can be arranged separately.

In a case of the two-solution type, there are contained in the A solution a zinc ion-supplying source, a phosphate ion-supplying source, a nitrate ion-supplying source, a nickel ion-supplying source, a manganese ion-supplying source, and a fluoride complex-supplying source. A simple fluoride-supplying source may be contained in only the C solution or, in case of necessity, it may also be contained in the A solution. A chlorate ion-supplying source may be contained in either the A solution or the B. A nitrite ion-supplying source, a meta-nitrobenzenesulfonate ion-supplying source, and a hydrogen peroxide-supplying source are contained in the B solution.

Besides, in a case where the A solution contains the manganese ion-supplying source, the chlorate ion source prefers to be contained in the B solution.

Since a component in a zinc phosphating solution is unevenly consumed during phosphating with zinc phosphate, this consumed part needs to be supplemented. A concentrated solution for this supplement is, for example, in the one-solution type concentrated source solution and the A, B, and C solutions, prepared by blending each component in a varying ratio according to consumed proportions of each component.

As a zinc phosphating process of a metal surface, when the dipping process by the first phosphating solution comprising the forementioned definite conditions and the spraying process by the second phosphating solution comprising similarly the definite conditions are performed in order, a zinc phosphating process can be nicely carried out for an iron-based, a zinc-based, and an aluminum-based surfaces, particularly for a metal surface which involves an aluminum-based metal surface having a part processed with an abrasive.

That is, by carrying out the dipping process with the first phosphating solution conditioned in the simple fluoride and fluoride complex concentrations, an excellent zinc phosphate coating film is formed for all metal surfaces except for the part of an aluminum-based metal surface processed with an abrasive. Since the first phosphating solution is relatively low in the simple fluoride concentration, excessive dissolution of an aluminum ion does not take place. However, on the part of an aluminum-based metal surface processed with an abrasive, where an inactive part of bad conversion exists, an excellent coating film is not formed by this dipping process alone.

Thus, for an phosphating object which has finished the dipping process, if a spraying process is carried out with the second phosphating solution which has been adjusted in the simple fluoride concentration as higher than that of the first phosphating solution, an excellent coating film is formed at the part of an aluminum-based metal surface processed with an abrasive where a coating film could not be formed with the dipping process. That is, in the spraying process, since a phosphating solution is blew for an phosphating object surface, a coating film-forming effect is enhanced and also, with use of the second phosphating solution having a higher simple fluoride concentration, the coating film-forming effect further increases and an excellent coating film is formed even at the part processed with an abrasive, where a coating film could not be formed by the dipping process. Besides, regarding a surface other than the part processed with an abrasive, since a zinc phosphate coating film has already been formed, excessive dissolution by the spraying process is not worried. Furthermore, since the phosphating solution blew for the phosphating object in the spraying process flows down immediately from the phosphating object surface, even if the simple fluoride concentration is high, a precipitate by an aluminum ion does not badly affect the coating film.

Also, when the spraying process is carried out after the dipping process, a precipitate attached to a phosphating object surface in the dipping process is washed off together with a phosphating solution by the spraying process and, therefore, there is solved a problem that the electrodeposition coating performance lowers due to the attaching of a precipitate.

Furthermore, in a case where the zinc phosphating process is carried out by only the spraying process, even if a good coating film is formed at a part of an aluminum-based metal processed with an abrasive, when a phosphating object involves complex uneven irregularities and a gap and hole, etc., the phosphating solution is not able to be brought in contact into an inner part of these uneven irregularities, etc., so that formation of an uniform coating film on a whole surface of the phosphating object is very difficult. However, when the dipping process is combined as in the present invention, an uniform coating film is formed on the whole surface in the dipping process regardless of uneven irregularities on the phosphating object.

Next, according to the invention described in the claim 2, since an identical phosphating solution is used by being circulated in a series of the dipping process, removing process of an aluminum ion precipitate, spraying process, and again, the dipping process, the phosphating solution is utilized with high efficiency and a separate arrangement of phosphating solutions in both the dipping and spraying processes is unnecessary.

As described before, in the present invention, although phosphating solutions which differ in setting conditions of the simple fluoride concentration must be used in both the dipping and spraying processes, because a simple fluoride is added to precipitate an aluminum ion in the aluminum ion-precipitating and removing process which is carried out for the phosphating solution used in the dipping process, the second phosphating solution for the spraying process is simply obtained from the first phosphating solution used in the dipping process, by properly adjusting an amount of the adding simple fluoride. Also, when the second phosphating solution is used in the spraying process, the simple fluoride concentration decreases during the spraying processing and, therefore, if the phosphating solution which has finished the spraying processing is used as itself in the dipping process, it becomes the first phosphating solution in the dipping process.

That is, in this process, even if separate phosphating solutions are not arranged in both the dipping and spraying processes, by carrying out an precipitating and removing process of an aluminum ion between the dipping and spraying processes and by only circulating the phosphating solution, the first and second phosphating solutions which are satisfactory for each desired condition can be very simply and surely supplied on any step of the dipping and spraying processes.

According to the process for phosphating a metal surface to make thereon a zinc phosphate coating film relating to the present invention so far mentioned, the dipping process by the first phosphating solution and the spraying process by the second phosphating solution are carried out in a series of combination, and thus, for a phosphating object which involves in combination a part of an aluminum-based metal surface processed with an abrasive, a part not processed with the abrasive, and other kinds of metal surfaces, an uniform and excellent zinc phosphate coating film can be formed at any one of the part processed with the abrasive and the part not processed.

As a result, for car bodies and other kinds of metal articles which very often involve the part processed with an abrasive, a zinc phosphate coating film which is superior in adhesion and corrosion-resistance can be formed. Also, when a metal surface on which a zinc phosphate coating film like the above has been formed undergoes electrodeposition coating, it is possible to make coating performance excellent.

DESCRIPTION OF THE PREFERRED EMBODIMENTS

Hereinafter, practical examples and examples for comparison in the present invention are presented, but this invention is not limited within the undermentioned examples and free variation in a range of the invention is possible.

Figure 1:
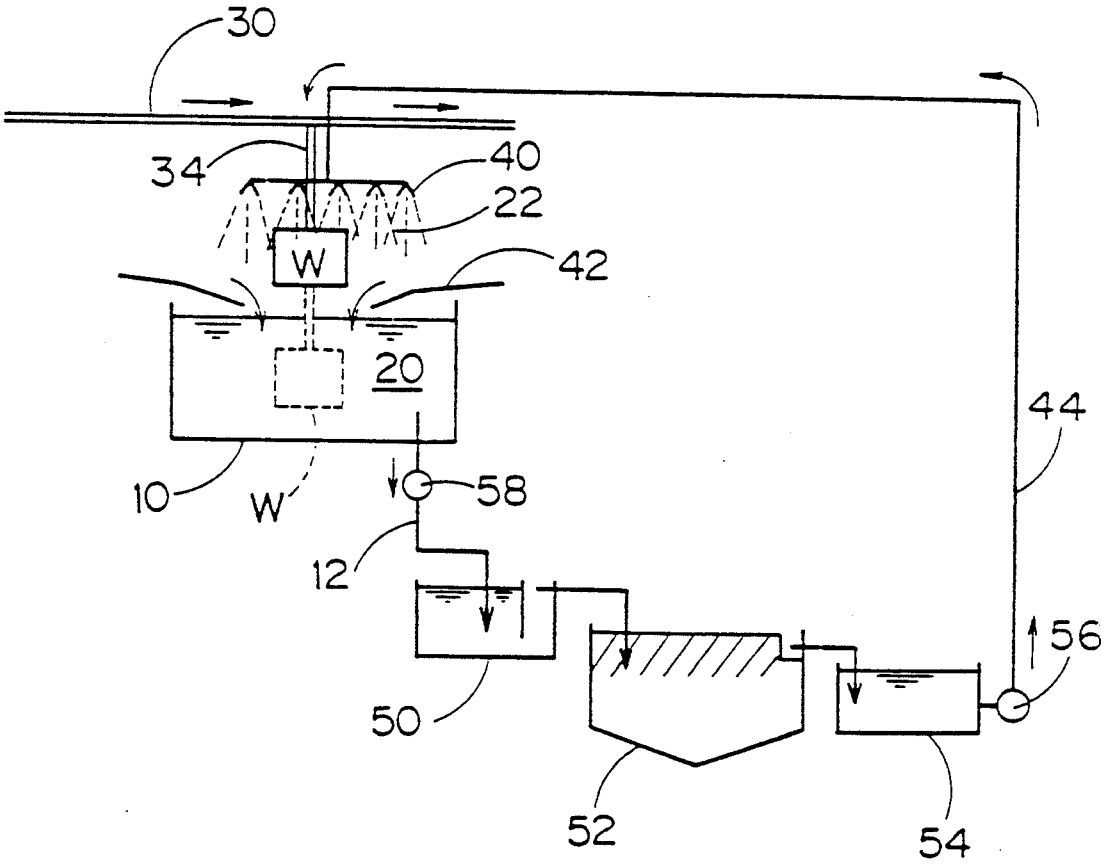
FIG. 1 is a structural view of a whole arrangement of a phosphating device showing an example of a process for phosphating a metal surface to make thereon a zinc phosphate coating film relating to the present invention.

FIG. 1 shows a whole structure of the phosphating devices used for performing the present invention.

In the dipping phosphating bath 10, the first phosphating solution 20 is stored in an amount capable of dipping a phosphating object W such as car bodies etc. The phosphating object W is put into the phosphating solution 20 in the dipping phosphating bath 10 under a condition of hanging the object onto an hanger 34 capable of freely going up and down in a hanger conveyer mechanism 30, the dipping process is carried out by slowly moving the dipping phosphating bath 10 or by stopping the bath for a certain time, and then the phosphating object W is taken out from the dipping phosphating bath 10.

A spraying mechanism 40 which sprays the second phosphating solution 22 is arranged above the dipping phosphating bath 10 and, with this mechanism 40, the object W hung onto the hanger 34 is phosphated by spraying. A solution-receiver 42, of which one end is connected with the dipping phosphating bath 10, is arranged below the spraying mechanism 40 and the phosphating solution 22 sprayed for the phosphating object W is received by the solution-receiver 42 and returned to the dipping phosphating bath 10.

The hanger conveyer mechanism 30 is continuously arranged in connection from the spraying mechanism 40 to the parts in the following processes such as a rinsing process, drying process, and electrodeposition coating process, etc. and, the phosphating object W which has finished zinc phosphating by the dipping and spraying processes is in order sent to later processes.

With the dipping phosphating bath 10, a pipe 12 and pump 58 which are for taking out the phosphating solution 20 are connected. The pipe 12 is connected with a precipitating bath 50, which is a device to precipitate an aluminum ion by adding a simple fluoride into the phosphating solution 20. Following after the precipitating bath 50, a precipitate-separating bath 52 is arranged, the phosphating solution 20 to which a simple fluoride was added is sent to the precipitate-separating bath 52 where the precipitate is separated with filtering off from the phosphating solution. The phosphating solution from which the precipitate has been taken off is sent to the next refluxing bath 54. Following after the refluxing bath 54, a pump 56 is set and its pouring-out opening is connected with a pipe 44, which further connects with the spraying mechanism 40. With a mechanism consisting of the forementioned precipitating bath 50, precipitate-separating bath 52, refluxing bath 54, and pump 56, are carried out processes for removing a precipitate from the phosphating solution and for a circulating supply.

EXAMPLE

Using the above-described phosphating devices, the zinc phosphating processes are carried out.

Phosphating object metal and phosphating area ratio

| | | |
|---|---|---|
| (A) | Cold rolled steel plate | 20% |
| (B) | Alloyed hot-dip zinc coated steel plate | 50% |
| (C) | Aluminum alloy plate comprising a part of abrasive-finishing (aluminum-magnesium alloy system) | 30% |

Phosphating solution

The compositions shown in Table 1 below-described were used. In Table, the HF corresponds to a simple fluoride and the $H_2SiF_6$ to a fluoride complex. Besides, a whole volume of the phosphating solution was 160 liters.

Phosphating process

The above-described three kinds of metal surfaces (A) to (C) are processed simultaneously to obtain coated metal plates according to each of the following processes:

(a) degreasing→(b) rinsing→(c) surface-conditioning →(d) converting (dipping process +spraying process)→(e) rinsing→(f) rinsing with deionized water→(g) drying→(h) coating.

Phosphating condition (a) Degreasing

A metal surface was dipped at 40° C. for 2 minutes in a 2% by weight aqueous solution of an alkaline degreasing agent (Surfcleaner SD 250, made by Nippon Paint Co., Ltd.). A degreasing bath is controlled so as to maintain an alkali extent (which is shown by a ml amount of 0.1 N-HCl required for neutralizing a 10 ml bath using bromophenol blue as an indicator) at an initial value. The forementioned Surfcleaner SD 250 was used as a drug for supplement.

(b) Rinsing

Using tap water, spray-rinsing by a pump pressure was carried out.

(c) Surface-conditioning

It is carried out with dipping at room temperature for 15 seconds in a 0.1% by weight aqueous solution of a surface-conditioner (Surffine 5N-5, made by Nippon Paint Co., Ltd.). A surface-conditioning bath is controlled by supplying the Surffine 5N-5 to maintain the alkali extent similarly to the above.

(d) Converting

It was carried out with a device shown in FIG. 1. In the dipping phosphating bath 10, one hundred liters of the first phosphating solution 20 was stored as an amount capable of dipping the phosphating object W. The phosphating object W is dipped in the phosphating solution 20 in the dipping phosphating bath 10 by the hanger 34 coming down. After dipping for 2 minutes, the phosphating object W was taken out above the dipping phosphating bath 10.

Next, with the spraying mechanism 40 arranged above the dipping phosphating bath 10, the second phosphating solution 22 was sprayed to carry out the spray-phosphating for the phosphating object W for 30 seconds. The phosphating solution 22 used for the spray-phosphating was returned from the receiver 42 to the dipping phosphating bath 10.

The phosphating object W which has finished the spray-phosphating is sent to the next rinsing process by the hanger mechanism 30.

From the dipping phosphating bath 10, the phosphating solution 20 was in order sent to the precipitating bath 50 (10 liters volume) through the pipe 12. In the precipitating bath 50, to precipitate an aluminum ion, a necessary amount of the simple fluoride was added to the phosphating solution 20, which was then sent to the precipitating bath 52 (40 liters volume). The phosphating solution from which the precipitate was removed in the precipitating bath 52 was sent to the refluxing bath 54 (10 liters volume) and supplied from the pipe 44 to the spraying mechanism 40 via the pump 56. The phosphating solution supplied for this spraying mechanism 40 became the forementioned second phosphating solution.

In the above process, temperature of the phosphating solution was kept at 40° C. The bath in the dipping phosphating bath 10 was controlled by maintaining the concentration of each ion composition and the free acidity (which is shown by a ml amount of a 0.1 N-NaOH solution required for neutralizing a 10 ml bath using bromophenolblue as an indicator) at the initial value. Into the dipping phosphating bath 10 were directly added, to maintain the concentration of each ion of Zn, $PO_4$, Mn, Ni, $NO_3$, and a silicofluoride, a concentrated phosphating agent for supplement A which contains zinc oxide, phosphoric acid, manganese nitrate, nickel carbonate, nitric acid, and silicofluoric acid corresponding to each ion, and to maintain the concentration of a $NO_2$ ion, a concentrated phosphating agent for supplement B which contains sodium nitrite. Also, into the precipitating bath 50 was added, to precipitate an aluminum ion, a concentrated phosphating agent for supplement C which contains sodium acid fluoride. By an added amount of the concentrated phosphating agent for supplement C, the simple fluoride or active fluorine concentration of the second phosphating solution 22 in the spraying process and that of the first phosphating solution 20 in the dipping phosphating bath 10 were adjusted and controlled in a range of defined numeral values. A silicon electrode meter (Surfproguard 101N, made by Nippon Paint Co., Ltd.) was used to determine the active flourine concentration in the dipping phosphating bath 10.

(e) Rinsing

It was carried out with tap water at room temperature for 15 seconds.

(f) Rinsing with deionized water

Dipping process was carried out with ion-exchanged water at room temperature for 15 seconds.

(g) Drying

It was carried out with a hot wind of 100° C. for 10 minutes.

(h) Coating

Using a cationic electrodeposition paint "Powertop U-1000" made by Nippon Paint Co., Ltd., cationic electrodeposition coating (film thickness 3 μm) was carried out according to a standard method and, using a melaminealkyd-based intermediate-top coating paint made by Nippon Paint Co., Ltd., intermediate and top coating (film thickness 30 and 40 μm) were carried out according to a standard method.

For comparison with the above-described Example, coated metal plates were also prepared according to the methods in Examples for comparison hereinafter explained.

EXAMPLE FOR COMPARISON 1

Figure 2:
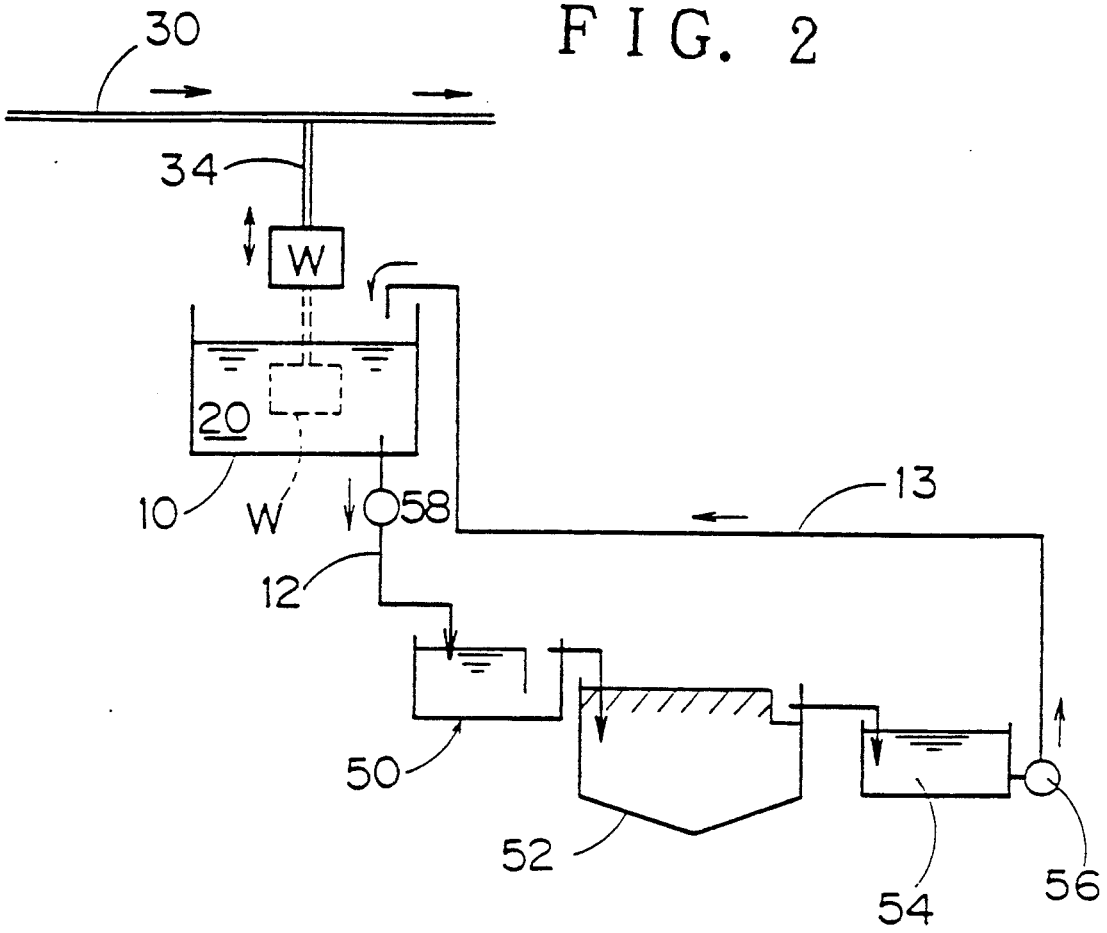
FIGS. 2 and 3 are, respectively, structural views of the whole arrangements of phosphating devices used in the different examples for comparison.

A device shown in FIG. 2 was used. Compared with the device in Example, the spraying mechanism 40 and pipe 44 were absent and a difference is that a pipe from the pump 56 is directly connected with the dipping phosphating bath 10. Then, as to the phosphating process, the processes of the forementioned Example were repeated to obtain the coated metal plate except that, in the converting process, the spraying process was not carried out, but only the dipping process.

EXAMPLE FOR COMPARISON 2

Figure 3:
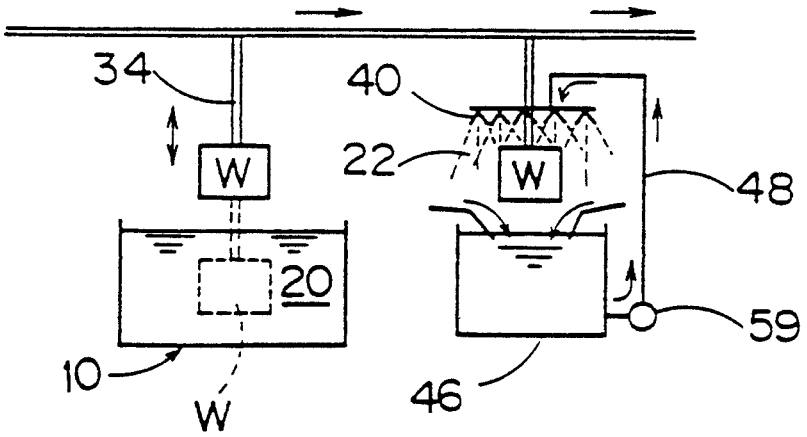

A device shown in FIG. 3 was used. Compared with the device in Example, the device for removing an aluminum ion in the phosphating solution is absent and the spraying mechanism 40 is arranged in a position different from the position of the dipping phosphating bath 10, and thus, different points are that the phosphating solution 22 sprayed by the spraying mechanism 40 is returned to the recovering bath 46 and is circulatingly supplied for the spraying mechanism 40 through the pump 59 and pipe 48. Then, as to the phosphating process, the processes of Example were repeated to obtain a coated metal plate except that, in the converting process, the concentrations and compositions, etc. of the first phosphating solution 20 and second phosphating solution 22 were controlled by adding the concentrated phosphating agent for supplement C, respectively, into the phosphating solutions in the dipping phosphating bath 10 and recovering bath 46 and that thereby the simple fluoride concentration of the second phosphating solution 22 was adjusted at 50 mg/l.

For Example and Examples for comparison 1 and 2, the converting performance in the converting process and the coating performance in the coating process were evaluated on a basis of the following standard.

Evaluation of converting performance

○ (circle) means that an uniform and excellent zinc phosphate coating film was formed.

X (cross) means that a coating film lacking in uniformity (a $Na_3AlF_6$-mixing case is included) or no coating film at all was formed.

Evaluation of coating performance

○ (circle) means that appearance and corrosion-resistance of a coating film were excellent.

X (cross) means that abnormal appearance and deterioration in corrosion-resistance of a coating film were observed.

Their evaluation results are presented in Table 1.

TABLE 1

| | Example | | Example for comparison 1 | Example for comparison 2 | |
|---|---|---|---|---|---|
| | Dipping process | Spraying process | Dipping process | Dipping process | Spraying process |
| Zinc phosphating solution | | | | | |
| Zn ion [g/l] | 1.0 | 1.0 | 1.0 | 1.0 | 1.0 |
| $PO_4$ ion [g/l] | 14.0 | 14.0 | 14.0 | 14.0 | 14.0 |
| Mn ion [g/l] | 0.8 | 0.8 | 0.8 | 0.8 | 0.8 |
| Ni ion [g/l] | 0.8 | 0.8 | 0.8 | 0.8 | 0.8 |
| HF [mg/l] | 200 | 300 | 250 | 200 | 50 |
| $H_2SiF_6$ [mg/l] | 50 | 50 | 50 | 50 | 50 |
| $NO_2$ ion [g/l] | 0.15 | 0.15 | 0.15 | 0.15 | 0.15 |
| $NO_3$ ion [g/l] | 4.0 | 4.0 | 4.0 | 4.0 | 4.0 |
| $\frac{[H_2SiF_6]}{[HF]}$ [mole ratio] | 0.34 | 0.23 | 0.27 | 0.34 | 1.35 |
| Total acidity (point) | 22.5 | 22.4 | 22.4 | 22.5 | 22.5 |
| Free acidity (point) | 0.8 | 0.8 | 0.8 | 0.8 | 0.8 |
| Active fluorine concentration | 15 to 20 | 40 | 25 | 15 to 20 | 3 to 5 |

TABLE 1-continued

| | Example | | Example for comparison 1 | Example for comparison 2 | |
|---|---|---|---|---|---|
| | Dipping process | Spraying process | Dipping process | Dipping process | Spraying process |
| (μA value indicated by silicon electrode meter) | | | | | |
| Converting performance | | | | | |
| Part of aluminum material processed with abrasive | | ○ | X | | X |
| Part other than above-described | | ○ | ○ | | ○ |
| Coating performance | | ○ | X | | X |

As seen in the results of Table 1, in Example the converting and coating performance were excellent for all the forementioned three kinds of phosphating object metals. On the other hand, in Example for comparison 1 in which the spraying process was not carried out, a non-uniform zinc phosphate coating film was formed at a part of the aluminum material processed with an abrasive and, compared with other parts, the corrosion-resistance of a coating film was in deterioration. Also, there is a tendency of which aluminum-containing sludge attaches to a surface of the phosphating object and a problem of which the skin of a electrodeposition coating film becomes non-uniform. Further, in Example for comparison 2 in which the simple fluoride concentration was too low in the spraying process, similarly to Example for comparison 1, a non-uniform zinc phosphate coating film was only formed at the part of the aluminum material processed with an abrasive.

What is claimed are:

1. A process for phosphating a metal surface to make thereon a zinc phosphate coating film, wherein a metal surface is brought in contact with a zinc phosphating solution, comprising dipping the metal surface into a first zinc phosphating solution containing a fluoride complex and a simple fluoride, wherein the concentration of the simple fluoride is 200 to 300 mg/l on a basis converted into the HF concentration and a concentration of the fluoride complex is shown as, (fluoride complex)/(simple fluoride)$\geqq$0.01 in a mole ratio with the simple fluoride converted into the HF concentration, and then spraying a second zinc phosphating solution having a simple fluoride concentration of 500 mg/l or less on a basis converted into the HF concentration, and wherein the simple fluoride concentration of the second zinc phosphating solution is higher than that of said first zinc phosphating solution.

2. A process for zinc phosphating as claimed in claim 1, comprising removing the first zinc phosphating solution used in the dipping process, adding thereto a simple fluoride, removing aluminum ion precipitate formed in said adding step, recycling this phosphating solution for use as the second phosphating solution in the spraying process, and returning the phosphating solution used in the spraying step to the dipping phosphating bath for use as the first zinc phosphating solution.

* * * * *